US008152296B2

(12) United States Patent
Maekawa et al.

(10) Patent No.: US 8,152,296 B2
(45) Date of Patent: Apr. 10, 2012

(54) VACUUM PLATEN MECHANISM AND FLUID DROPLET DISCHARGE DEVICE

(75) Inventors: Hironori Maekawa, Nagano-ken (JP); Shun Oya, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 250 days.

(21) Appl. No.: 12/711,518

(22) Filed: Feb. 24, 2010

(65) Prior Publication Data

US 2010/0220165 A1 Sep. 2, 2010

(30) Foreign Application Priority Data

Mar. 2, 2009 (JP) ..... 2009-047673

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 4,298,277 | A * | 11/1981 | Silverberg | 355/76 |
| 6,637,328 | B1 * | 10/2003 | Berrigan | 101/226 |
| 7,093,933 | B2 | 8/2006 | Tsuji et al. | |
| 7,296,792 | B2 * | 11/2007 | Kondratuk et al. | 271/197 |
| 7,578,629 | B2 * | 8/2009 | Kruijt | 400/645 |
| 8,025,390 | B2 * | 9/2011 | Phillips et al. | 347/104 |
| 2002/0097311 | A1 * | 7/2002 | Hinojosa et al. | 347/104 |
| 2004/0239742 | A1 * | 12/2004 | Hiraki et al. | 347/104 |
| 2005/0095046 | A1 | 5/2005 | Beehler | |
| 2006/0098070 | A1 * | 5/2006 | Kumagai | 347/101 |
| 2006/0132572 | A1 * | 6/2006 | Mochizuki et al. | 347/104 |
| 2007/0146456 | A1 | 6/2007 | Tanabe | |
| 2008/0213027 | A1 * | 9/2008 | Yraceburu et al. | 400/648 |

FOREIGN PATENT DOCUMENTS

| | | |
|---|---|---|
| JP | 2001-162870 | 6/2001 |
| JP | 2004-216653 | 8/2004 |
| JP | 2004-268544 | 9/2004 |
| JP | 2005-138305 | 6/2005 |
| JP | 2005-138305 A | 6/2005 |
| JP | 2006-103327 | 4/2006 |
| JP | 2007-168387 | 7/2007 |
| JP | 2009-126034 | 6/2009 |

* cited by examiner

*Primary Examiner* — Stephen Meier
*Assistant Examiner* — Leonard S Liang

(57) ABSTRACT

Mechanism for producing vacuum pressure and air flow for drawing recording paper of various widths to the platen surface of a printer enables such pressure and air flow to be held in a suitable range without adjusting the suction. A first suction area with the same width as the minimum width of the recording paper is disposed width-wise in the middle of the platen surface that opposes the inkjet head of the printer, and second suction areas are disposed on the left and right sides of the first suction area. The first suction area is divided into a grid by intersecting ribs to form first chambers, each having a first suction hole formed in a bottom thereof that communicates with a vacuum channel. The second suction areas are also segmented to form second chambers. Second suction holes are selectively formed in some, but not all, of the second chambers and are appropriately spaced from the first suction holes. The front edge of the first suction area is offset slightly from the front edge of the second suction areas.

10 Claims, 7 Drawing Sheets

VACUUM PLATEN MECHANISM AND FLUID DROPLET DISCHARGE DEVICE

CROSS-REFERENCE TO RELATED APPLICATION(S)

Japanese Patent application No. 2009-047673 is hereby incorporated by reference in its entirety.

BACKGROUND

1. Field of Invention

The present invention relates to a fluid droplet discharge device such as a printer that has a vacuum platen that pulls recording paper to a platen surface that determines the printing position, and relates more particularly to an improved suction hole and the surface configuration of the vacuum platen.

2. Description of Related Art

Holding the recording paper tight to the platen surface that defines the printing position and maintaining a precise platen gap is important in order to ensure print quality in an inkjet printer, which discharges ink droplets to print on the recording paper. Therefore, in order to so hold the recording paper while it is conveyed, a vacuum platen is used to pull the recording paper to the platen surface by means of air suction while the recording paper is conveyed by paper feed rollers. A vacuum platen has numerous suction holes for pulling the recording paper to the platen surface of a box-shaped platen unit. Negative pressure is produced inside the printer by discharging air from the inside to the outside by means of a fan, thereby pulling and holding the recording paper to the platen surface.

Japanese Unexamined Patent Appl. Pub. JP-A-2005-138305 is directed to a printer that has a vacuum platen of which the surface is divided into a grid by a plurality of spaced parallel ribs extending in the recording paper transportation direction on the platen surface, and dividers that divide the spaces between the ribs perpendicularly to the recording paper transportation direction. In such an arrangement, one suction hole is disposed in the bottom of each well surrounded by the ribs and dividers, and when the recording paper is conveyed to a position covering each well, each well becomes a closed space to which suction is applied through the suction hole. A drop in vacuum pressure caused by air leakage from the suction holes when the recording paper does not cover the entire platen surface is thereby suppressed, and a drop in print quality is suppressed.

As is known, if vacuum air flow increases due to air leakage from one or more of the suction holes, the vacuum pressure decreases. In order to appropriately hold the recording paper to the platen surface, the air flow including air leakage must be set and the vacuum platen must be designed to achieve a desirable vacuum pressure within a suitable pressure range.

With the arrangement of JP-A-2005-138305, a closed space is formed around each suction hole covered by the recording paper as a result of dividing the platen surface into numerous suction chambers by means of ribs and dividers. This configuration suppresses air leakage when the recording paper does not cover the entire area of the platen surface, and suppresses an increase in air flow and a drop in vacuum pressure.

However, with the configuration of JP-A-2005-138305 that renders numerous suction chambers and suction holes evenly distributed over the platen surface, many suction holes are outside the width of the recording paper and open to the air when printing on recording paper having a small width. As a result, air leakage from the suction holes on both sides of the paper width is great even after the leading end of the recording paper reaches a position near the downstream end (front end) of the vacuum platen in the transportation direction, and, as a result, the vacuum pressure may be outside the suitable pressure range Pa.

In this situation it is conceivable to adjust the vacuum pressure to within a range suitable for the recording paper by adjusting the suction force of the vacuum fan according to the width of the recording paper and the position reached by the leading end of the recording paper. Alternatively, if the platen surface is divided into a plurality of areas and suction can be applied independently to each area, suction can be applied to only the necessary areas according to the width of the recording paper and the position to which it has been conveyed, and the vacuum pressure can be adjusted to within the suitable range. However, applying such adjustment control and providing such an adjustment mechanism makes vacuum control more complex, or results in a more complex vacuum mechanism and increased parts cost.

SUMMARY OF INVENTION

The present invention enables maintaining the vacuum pressure and vacuum air flow to draw various widths of recording paper to the platen surface without the need for adjusting suction based on the paper width or transportation position.

A first aspect of the invention is directed to a vacuum platen mechanism comprising a platen surface disposed opposite a fluid droplet discharge head; and a vacuum mechanism that creates suction to draw recording paper to the platen surface. The platen surface includes a first suction area positioned approximately in the center of the platen surface in a width direction that is perpendicular to a direction in which the recording paper is conveyed, and a second suction area on each side of the first suction area. The first suction area includes a plurality of first ribs extending in the recording paper transportation direction and a plurality of second ribs extending in the width direction defining a plurality of first chambers arranged in a grid layout, the first suction area defining a plurality of rectangular-shaped first suction holes, each rendered in a respective one of the first chambers. The second suction area defines a plurality of second suction holes that are non-rectangular-shaped, arranged in a different layout than the first suction holes, or both.

Because a middle strip of platen surface is divided into a grid with the bottoms of each chamber in the grid forming a rectangular first suction hole, substantially the entire area of the first suction area except for the ribs is open, the aperture ratio is relatively high, and suction in this area is strong. By disposing this first suction area in the middle (width-wise) of the platen surface, all or substantially all of the first suction holes are covered by the recording paper thereby preventing a significant drop in vacuum pressure, even when narrow-width recording paper is used, and air leakage from any first suction hole can be minimized.

In addition, because both edges on opposite sides of the width of a wide-width recording paper are drawn to the platen surface in the second suction area by the vacuum pressure from the second suction holes, the right and left edges of the recording paper can be prevented from lifting up. As a result, recording paper of various paper widths can be held and conveyed flat without adjusting the vacuum pressure of the vacuum fan. The configuration and control of the vacuum mechanism can therefore be simplified and a low device cost can be achieved.

Preferably, the width of the first suction area is less than or equal to a minimum width of a guide that constrains both sides of the conveyed recording paper. This aspect of the invention reduces the drop in vacuum pressure even when conveying recording paper of the narrowest width because the entire first suction area is covered by the recording paper.

Yet further preferably, relative to the transportation direction of the recording paper, a downstream end of the first suction area is offset a specific distance to the upstream side from a downstream end of the second suction area.

More specifically, the downstream (front) end of the first suction area is removed slightly to the upstream side in the transportation direction from the front end of the left and right second suction areas. As a result, when the leading end of the recording paper is indexed to the printing start position and printing starts, the dispersion of fluid droplets to the downstream (front) side caused by the vacuum current flowing around the leading end of the recording paper toward the first suction hole can be suppressed. The suction of fluid droplets around the leading end of the recording paper into the first suction holes can also be suppressed. A drop in print quality at the leading end of the recording paper can therefore be suppressed.

Yet further preferably, a plurality of third ribs extends generally in the recording paper transportation direction, but at a slight angle thereto, so that the downstream end opens to the outside, are formed side by side in the second suction area, and a fourth rib extends in the width direction, thereby defining a plurality of second chambers in the second suction area. At least the second chamber farthest from the first suction area defines one of a plurality of second suction holes and at least the second chamber closest to the first suction area has no suction hole formed therein.

The part of the recording paper conveyed over the second chambers close to the first suction area does not particularly rise because the part of the recording paper travelling over the first suction area is pulled down reliably by the force of suction in that area. However, the part of the recording paper conveyed over the chamber far from the first suction area may rise easily because of the distance from the first suction area. Therefore, by forming a second suction hole on each side of, and relatively far from, the first suction area and not forming a suction hole in the second suction area near the first suction area, the open area of the suction holes in the second suction area can be reduced while the part of the recording paper extending out from the first suction area can effectively be held flat.

In addition, by forming third ribs at a slight angle to the transportation direction so that the downstream side opens to the outside, the recording paper is conveyed with the leading end of the recording paper crossing diagonally over adjacent third ribs. Sounds of vibration caused by the air current causing the edges of the recording paper to vibrate can therefore be suppressed. In addition, by rendering the third ribs at an angle to the transportation direction so that the downstream end opens to the outside, the leading end of the recording paper meets the sides of the ribs and is guided gradually to the center of the platen surface, and interference with transportation of the recording paper can be suppressed.

Yet further preferably, an open area or an aperture ratio of a second suction hole in the chamber on the downstream side of the fourth rib in the recording paper transportation direction is greater than that of a second suction hole on the upstream side of the fourth rib in the recording paper transportation direction.

The plural third ribs can be arranged at substantially equal intervals across the width. If the open area or the aperture ratio of the chambers on the front side in the transportation direction is increased, the part of the recording paper extending out from the first suction area can be pulled down more reliably at the leading end where the recording paper easily lifts away from the platen. Therefore, while reducing the open area of the suction holes in the second suction areas, the part of the recording paper extending out from the first suction area can be effectively held flat.

Yet further preferably, each of the ribs extending in the width direction is formed lower than each of the ribs extending in the recording paper transportation direction or at a slight angle thereto. This aspect of the invention can suppress the leading end of the recording paper catching on the lateral ribs that extend in the width direction.

Yet further preferably, the vacuum mechanism has a vacuum channel that communicates with the platen surface top through the first or second suction holes, and a vacuum fan that draws air with a set suction force from the vacuum channel.

Another aspect of the invention is a fluid droplet discharge device having the vacuum platen mechanism described above, and a fluid droplet discharge head that discharges fluid droplets onto the recording paper conveyed along the platen surface of the vacuum platen mechanism.

EFFECT OF THE INVENTION

The invention renders a first suction area in which a middle strip of the platen surface is divided into a grid with the bottom of each chamber in the grid forming a rectangular first suction hole; the aperture ratio is therefore extremely high and suction in this area is strong. Moreover, by so disposing the first suction area, substantially all of the first suction holes in the first suction area are covered by the recording paper even when recording paper with a narrow paper width is conveyed, and air leakage from the first suction holes can be minimized. The vacuum pressure can therefore be prevented from particularly dropping even when recording paper with a narrow paper width is pulled to the platen.

In addition, because both edges on opposite sides of the width of wide recording paper are drawn to the platen surface in the second suction area by the vacuum pressure from the second suction holes, the right and left edges of the recording paper can be prevented from lifting up. As a result, recording paper of various paper widths can be held and conveyed flat without adjusting the vacuum pressure of the vacuum fan. The configuration and control of the vacuum mechanism can therefore be simplified and a low device cost can be achieved.

Other objects and attainments together with a fuller understanding of the invention will become apparent and appreciated by referring to the following description and claims taken in conjunction with the accompanying drawings.

DESCRIPTION OF EXEMPLARY EMBODIMENTS

A roll paper printer (fluid droplet discharge device) having a vacuum platen mechanism according to a preferred embodiment of the invention is described below with reference to the accompanying figures.

General Configuration

Figure 1:
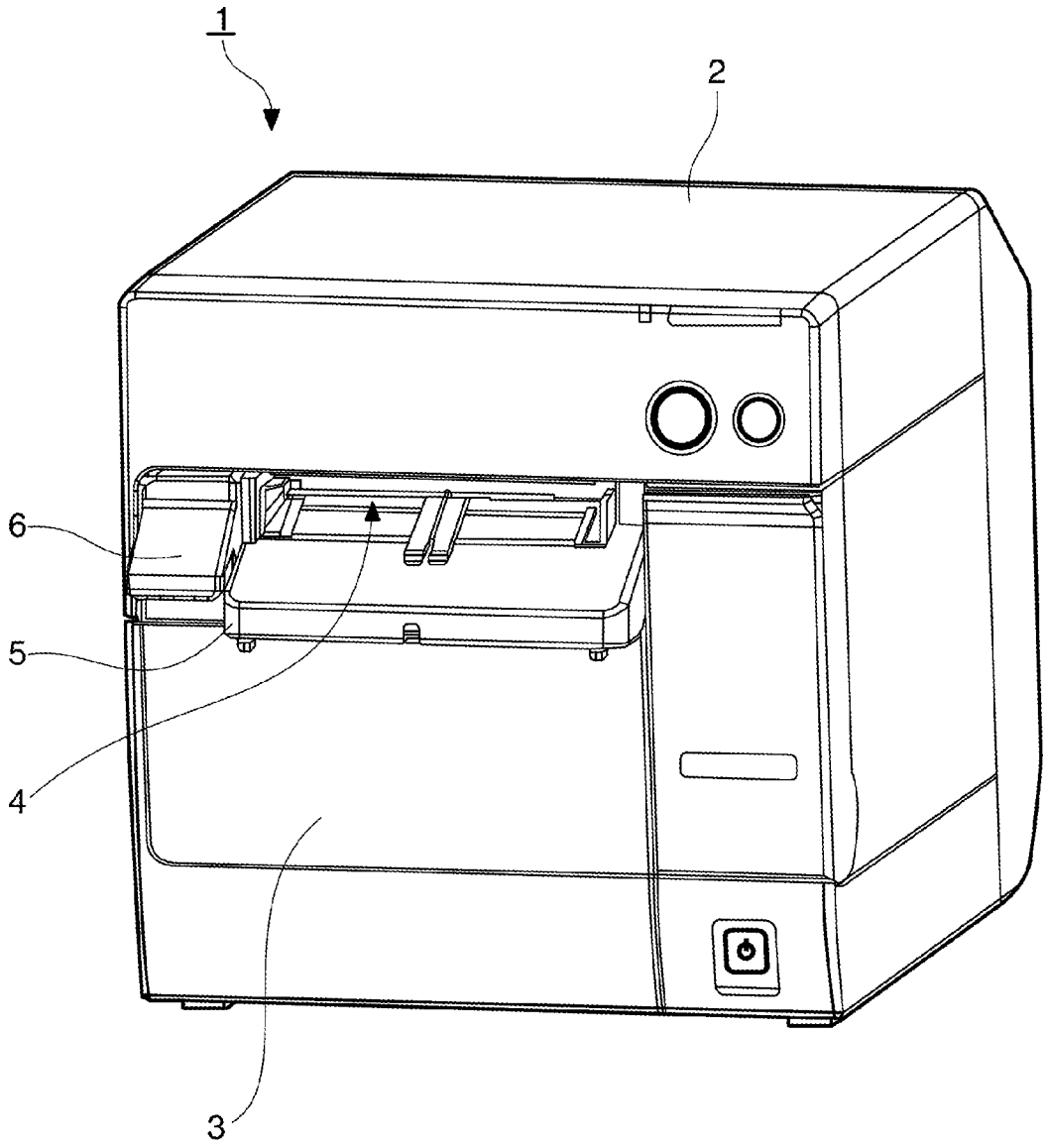
FIG. 1 is an external oblique view of a roll paper printer according to a preferred embodiment of the invention.
Figure 2:
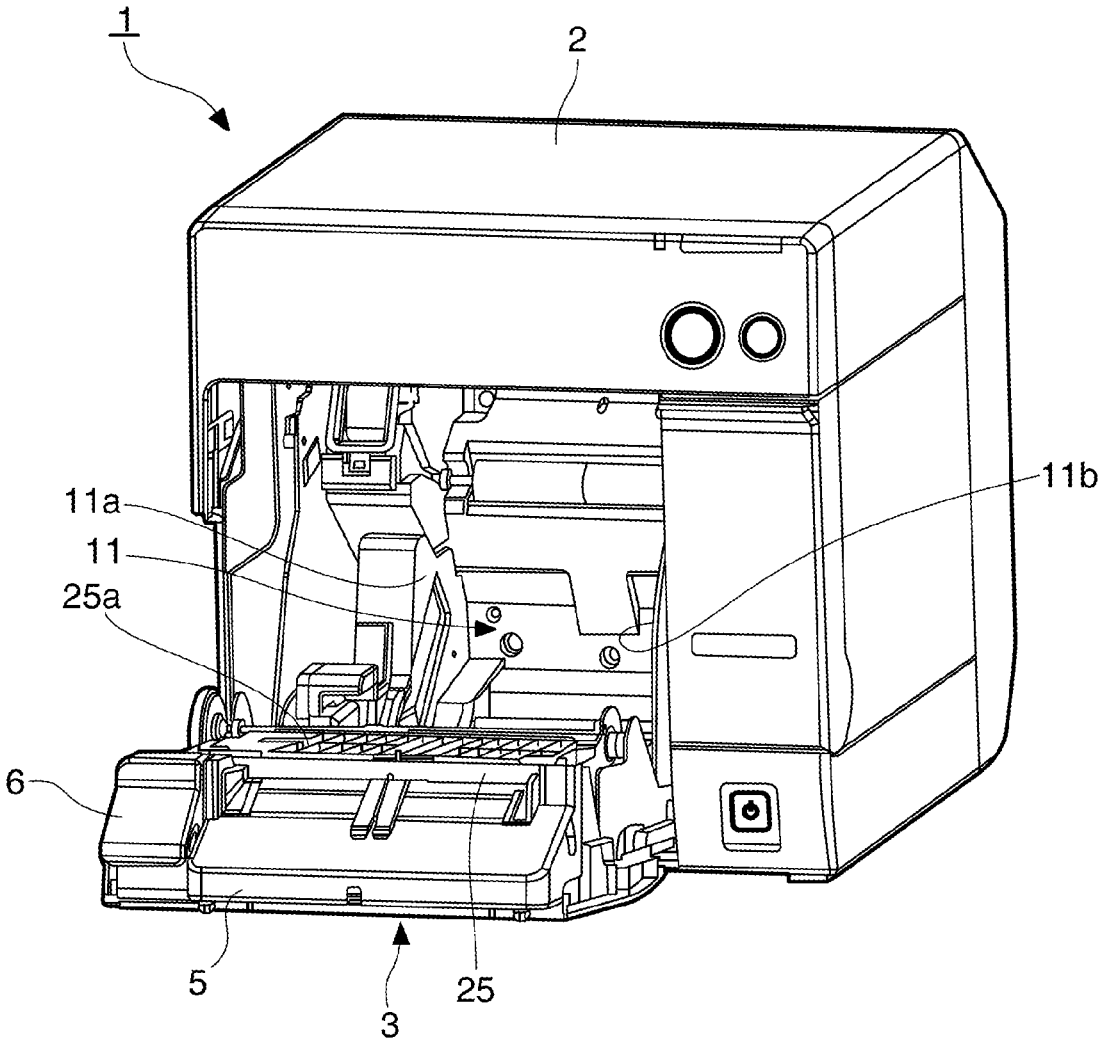
FIG. 2 is an external oblique view of the roll paper printer with the access cover open.

FIG. 1 is an oblique view showing an inkjet roll paper printer according to a preferred embodiment of the invention. FIG. 2 is an oblique view of the printer with the cover completely open.

The roll paper printer 1 has a rectangular box-like body 2 and an access cover 3 that opens and closes and is disposed to the front of the body 2. A recording paper exit 4 of a specific width is formed at the front of the outside case of the printer body 2. An exit guide 5 projects to the front from the bottom of the paper exit 4, and a cover opening lever 6 is disposed beside the exit guide 5. A rectangular opening for loading and removing roll paper is formed below the exit guide 5 and cover opening lever 6, and this opening is closed by the cover 3.

Operating the cover opening lever 6 unlocks the cover 3. When the exit guide 5 is pulled forward after unlocking the cover, the cover 3 pivots at the bottom end part thereof and opens forward to a substantially horizontal position as shown in FIG. 2. The roll paper transportation path from the roll paper compartment 11 to the paper exit 4 becomes open at the same time, and the roll paper can be easily replaced from the front of the printer.

Figure 3:
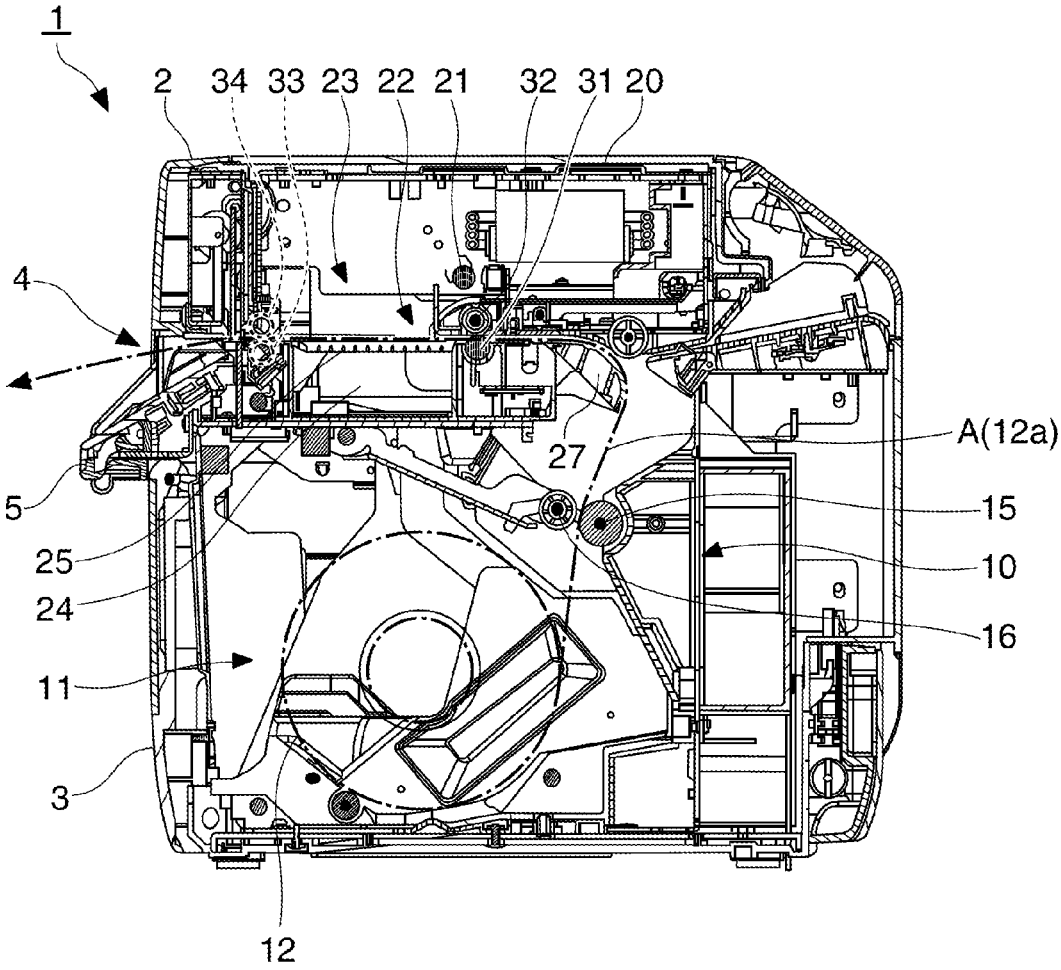
FIG. 3 is a vertical section view showing the internal structure of the roll paper printer.

FIG. 3 shows the internal configuration of the roll paper printer 1. A roll paper compartment 11 is formed in the center between the side walls of the printer frame 10 inside the roll paper printer 1. Roll paper 10 is loaded inside the roll paper compartment 11 facing the width of the printer so that the roll paper can roll on its side. A left-side guide 11*a* and a right-side guide 11*b* that restrict sideways movement of the roll paper 12 and the recording paper 12*a* pulled off the roll paper 12 are disposed inside the roll paper compartment 11. The left-side guide 11*a* and right-side guide 11*b* can move to the left and right symmetrically to the center by means of a rack and pinion mechanism.

A head unit frame 20 is disposed horizontally at the top of the printer frame 10 above the roll paper compartment 11. A carriage guide shaft 21 is disposed to the head unit frame 20 horizontally widthwise to the printer. A carriage 23 on which the inkjet head 22 is mounted facing down can travel bi-directionally widthwise to the printer along this carriage guide shaft 21. The carriage 23 is moved bi-directionally widthwise to the printer by means of a carriage transportation mechanism known from the literature, such as a carriage transportation mechanism having a carriage motor and a timing belt.

A platen frame 24 that extends horizontally in the direction between the front and back of the printer is disposed below the inkjet head 22. A platen 25 opposing the inkjet head 22 with a specific gap therebetween is disposed horizontally widthwise to the printer on the platen frame 24. This platen 25 determines the printing position of the inkjet head 22.

A tension guide 27 around which the recording paper 12*a* leader pulled from the roll paper 12 stored in the roll paper compartment 11 passes is disposed at the back end of the platen frame 24. The tension guide 27 is urged upward, and the recording paper 12*a* pulled from the roll paper 12 stored in the roll paper compartment 11 is pulled along the roll paper transportation path passed the printing position with a specific amount of tension applied thereto by the tension guide 27.

A paper feed roller 31 is disposed horizontally widthwise to the printer at a position on the platen frame 24 in front of the tension guide 27. A paper pressure roller 32 disposed on the head unit frame 20 side is pressed from above with a specific amount of pressure against the paper feed roller 31 with the recording paper 12*a* therebetween. A front paper feed roller 33 is disposed to the platen frame 24 horizontally widthwise to the printer at a position on the front end side of the platen 25. A front paper pressure roller 34 disposed on the head unit frame 20 side is pressed from above against the front paper feed roller 33 with the recording paper 12*a* therebetween.

The recording paper 12*a* pulled up and off the roll paper 12 stored in the roll paper compartment 11 is conveyed along transportation path A indicated by the bold dot-dash line in FIG. 3. This transportation path A travels up between a delivery roller 15 and a paper pressure roller 16. The recording paper 12*a* then curves to the front around the tension guide 27, then passes between the paper feed roller 31 and the paper pressure roller 32, between the inkjet head 22 and the platen 25, and between the front paper feed roller 33 and the front paper pressure roller 34 to the paper exit 4.

The part of the recording paper 12*a* pulled from the roll paper 12 is conveyed and passes the printing position while being held by suction to the surface of the platen 25. At the printing position the carriage 23 moves bi-directionally along the carriage guide shaft 21 while the paper is printed by means of the inkjet head 22 disposed to the carriage 23. After printing one line along the width of the recording paper 12*a* is completed, the delivery roller 15, paper feed roller 31, and front paper feed roller 33 are rotationally driven synchronously and the recording paper 12*a* is advanced a specified pitch. The next line is then printed. The recording paper 12*a* is thus printed by the inkjet head 22 while being intermittently advanced a specified pitch. The printed recording paper 12*a* is then cut across the width thereof by an automatic paper cutter disposed at the paper exit 4, and discharged.

Platen and Vacuum Mechanism

Figure 4:
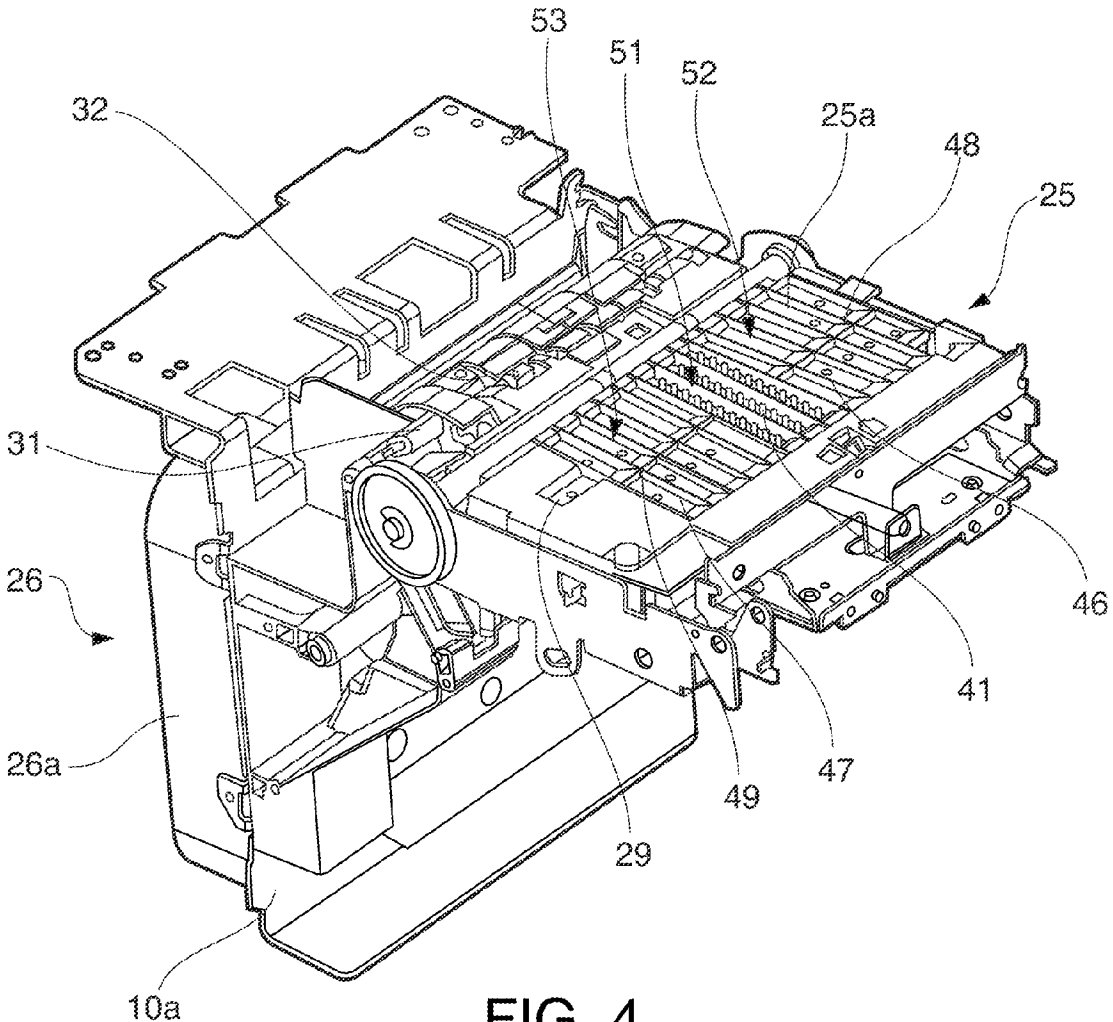
FIG. 4 is a partial oblique view showing the platen and vacuum mechanism in the internal mechanisms of the printer.

FIG. 4 is a partial oblique view showing the platen 25 and vacuum mechanism 26 part of the internal mechanism of the printer.

The platen 25 has a flat, rectangular shape that is long widthwise to the printer.

The platen surface 25*a* disposed to the top of the platen 25 is defined by the top edges of the longitudinal ribs 41 described below that extend in the recording paper transportation direction, and the top edges of longitudinal ribs 46 and 47 described below that extend at a slight angle to the recording paper transportation direction.

The paper feed roller 31 and paper pressure roller 32 are disposed at a position on the upstream side of the platen surface 25*a*.

A recovery unit 29 is disposed integrally to the platen 25 on a side of the platen 25. The recovery unit 29 recovers ink mist resulting from the ink droplets discharged from the inkjet head 22, or paper dust clinging to the recording paper.

A plurality of suction holes (referred to as first suction hole 45 and second suction holes 54 and 55 below) are formed in the platen surface 25*a*, and each of the suction holes communicates with a vacuum channel (not shown in the figure) formed inside the platen 25. A communication hole that communicates with the vacuum channel is formed in the back end of the platen 25, and an L-shaped vacuum duct (not shown in the figure) is connected thereto with an airtight connection.

The back end of the vacuum duct communicates with the suction mouth of the vacuum fan 26*a*, which is attached to the back panel 10*a* of the printer frame 10. The discharge opening of the vacuum fan 26*a* opens to the back of the printer. When the vacuum fan 26*a* is driven, air is pulled from the first suction hole 45 and the second suction holes 54 and 55 through the vacuum channel and the vacuum duct inside the platen 25. The recording paper 12*a* conveyed over the top of the platen 25 is conveyed while being pulled to the platen surface 25*a* by the suction power thus produced by the vacuum fan 26*a*.

Figure 5:
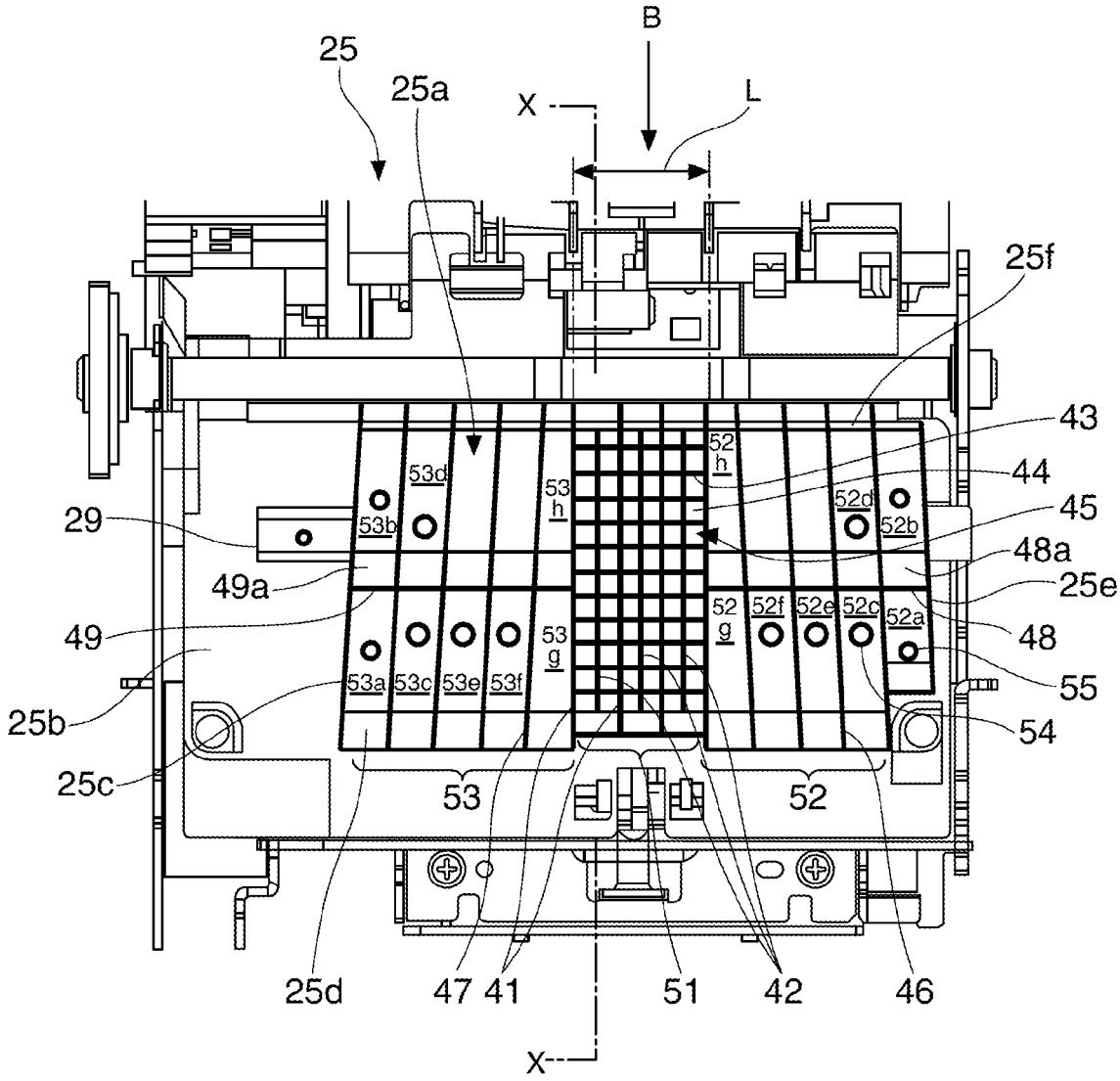
FIG. 5 is a plan view showing the surface of the platen.

FIG. 5 is a plan view showing the surface of the platen 25.

The platen surface 25*a* is substantially rectangular, and the bottom is recessed between the ribs extending longitudinally and laterally. The front of the platen surface 25*a* in the transportation direction, and the side on the side where the recovery unit 29 is formed, are contained substantially in an L-shaped configuration by flat portion 25*b* and divider walls 25*c* and 25*d*. The flat portion 25*b* is formed at substantially the same height as the top edge of the longitudinal ribs 46 and 47. The other side and the back end in the transportation direction are contained by side rib 25*e* and back rib 25*f*. Divider wall 25*c* and side rib 25*e* are inclined to the recording paper transportation direction B in the direction opening to the outside widthwise to the platen surface 25*a* in the downstream direction. In this embodiment of the invention they are inclined 3° to the left and right relative to the recording paper transportation direction B.

The platen surface 25*a* surrounded by the divider walls 25*c* and 25*d*, side rib 25*e*, and back rib 25*f* has a first suction area 51 formed in the center of the platen width (the direction perpendicular to the recording paper transportation direction B), and second suction areas 52 and 53 on the right and left sides of the first suction area 51. In this embodiment of the invention the center of the width of the platen surface 25*a*, that is, the center of the first suction area 51, is the reference line for recording paper 12*a* transportation, and the left and right second suction areas 52 and 53 are disposed symmetrically to this line. The width L of the first suction area 51 is less than the minimum width of the recording paper 12*a* that is conveyed through the printer 1. More specifically, this width L is less than or equal to the smallest width that can be set by the left-side guide 11*a* and right-side guide 11*b* in the roll paper compartment 11.

Four longitudinal ribs 41 (first ribs) extending in the recording paper transportation direction B are formed at equal intervals in the first suction area 51, and longitudinal ribs 42 (first ribs) that are shorter than the longitudinal ribs 41 are formed parallel to the longitudinal ribs 41 in the center of the width of the three channels rendered between adjacent longitudinal ribs 41.

Numerous lateral ribs 43 (second ribs) are also formed in the first suction area 51 extending in the direction perpendicular to the recording paper transportation direction B, that is, widthwise to the platen surface 25*a*.

The tops of the longitudinal ribs 42 and lateral ribs 43 are at the same height and are lower than the tops of the longitudinal ribs 41.

The first suction area 51 is thus divided by the longitudinal ribs 41 and 42 at equal intervals into six channels, and is divided by the lateral ribs 43 at equal intervals into numerous parts in the recording paper transportation direction B. The first suction area 51 is thus a configuration having a two-dimensional matrix of chambers 44 each having the same plane shape. A bottom surface is not formed in the bottom part of the chambers 44, and this bottom part renders a first suction hole 45 that communicates with the vacuum channel formed inside the platen 25.

Four longitudinal ribs 46 extending parallel to the side rib 25*e*, and four longitudinal ribs 47 extending parallel to the divider wall 25*c*, are formed in the second suction areas 52 and 53.

Lateral ribs 48 and 49 extending perpendicularly to the recording paper transportation direction B are also formed in the second suction areas 52 and 53. The lateral ribs 48 and 49 are formed at a position in the center of the recording paper transportation direction B in the second suction areas 52 and 53. Similarly to the lateral ribs 43, the tops of the lateral ribs 48 and 49 are lower than the tops of the longitudinal ribs 46 and 47. The second suction area 52 has four longitudinal chambers of the same width extending at a 3° angle to the recording paper transportation direction B, and one longitudinal chamber that gradually increases in width in the downstream direction, rendered by the longitudinal ribs 46. These five longitudinal chambers are each divided front and back into two parts by the lateral ribs 48 at a position in the center in the recording paper transportation direction B.

Round second suction holes 54 and 55 are formed in the second suction areas 52 and 53. The second suction holes 54 are larger than the second suction holes 55. The distribution of the second suction holes 54 and 55 in the second suction areas 52 and 53 is described next.

One second suction hole 55, which has the smaller open area, is formed in the bottom of each chamber 52*a*, 52*b* and chamber 53*a*, 53*b* in the last outside row in the widthwise direction of the second suction areas 52 and 53.

One second suction hole 54, which has the larger open area, is formed in each chamber 52*c*, 52*d* and chamber 53*c*, 53*d* in the second to last outside row in the widthwise direction of the second suction areas 52 and 53.

One second suction hole 54 is also formed in each chamber 52*e*, 52*f* and chamber 53*e*, 53*f* at the front in the recording paper transportation direction B of the third and fourth rows from the outside of the second suction areas 52 and 53 in the widthwise direction.

Both second suction holes 54 and 55 are formed in the chambers 52*g*, 52*h*, 53*g*, 53*h* that are in the row closest to the first suction area 51.

Inclined surfaces 48*a*, 49*a* that slope from the top of the lateral ribs 48 and 49 toward the bottom of each chamber in the second suction areas 52 and 53 are formed at a position on the upstream side of the lateral ribs 48 and 49 in the second suction areas 52 and 53. The divider walls 25*d* at the front of the second suction areas 52 and 53 also slope from the top of the divider wall 25*d* toward the bottom of each chamber in the second suction areas 52 and 53. These slopes can guide and lift the leading end of the recording paper 12*a* conveyed from the upstream side of the recording paper transportation direction. Problems caused by the leading edge of the recording paper 12*a* hitting and catching a step at the lateral ribs 48 and 49 or divider wall 25*d* can thus be prevented.

Figure 6:
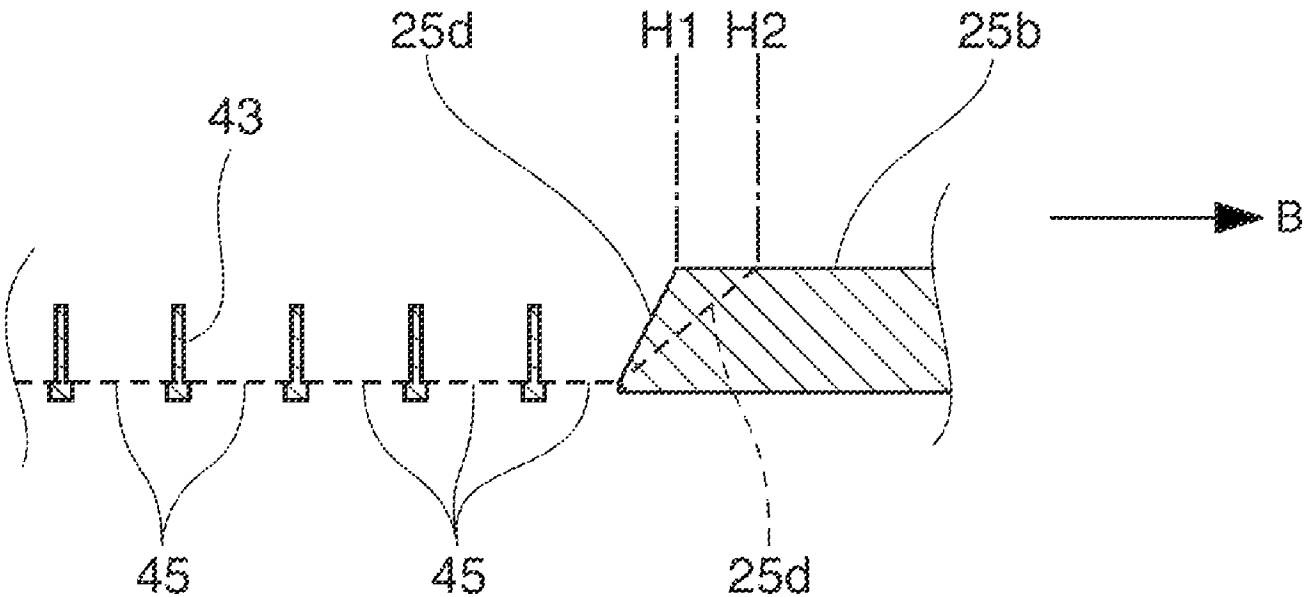
FIG. 6 is a partial section view of the platen through line X-X in FIG. 5.

FIG. 6 is a partial section view of the platen 25 through line X-X in FIG. 5.

The divider wall 25*d* connects to the flat portion 25*b* in the first suction area 51 at a position offset a specific distance to the back in the recording paper transportation direction B so that the front edge H1 of the first suction area 51 is positioned offset to the back in the recording paper transportation direction B from the front edges H2 of the left and right second suction areas 52 and 53.

With the platen 25 having the surface configuration according to this embodiment of the invention, the aperture ratio of the first suction area 51 is large, and the suction power is high because the first suction hole 45 is rendered by the bottom portion of each chamber 44 in the chamber grid of the first suction area 51, and except for the longitudinal ribs 41 and 42 and the lateral ribs 43 substantially the entire area of the first suction area 51 is open.

However, second suction holes 54 and 55 are rendered at most in only one place in the chambers of the second suction areas 52 and 53.

Therefore, if the first suction area 51 is located in the center of the width of the platen surface 25*a* and the width of the first suction area 51 is less than or equal to the smallest width of the recording paper 12*a*, the recording paper 12*a* traveling over the platen surface 25*a* can always cover the entire area of the first suction area 51. Suction in the first suction area 51 acting on the recording paper 12*a* can therefore be increased even when recording paper 12*a* with the narrowest width is pulled thereto. Air leakage from the second suction holes 54 and 55 not covered by the edges of the recording paper 12*a* is also not particularly great.

Figure 7:
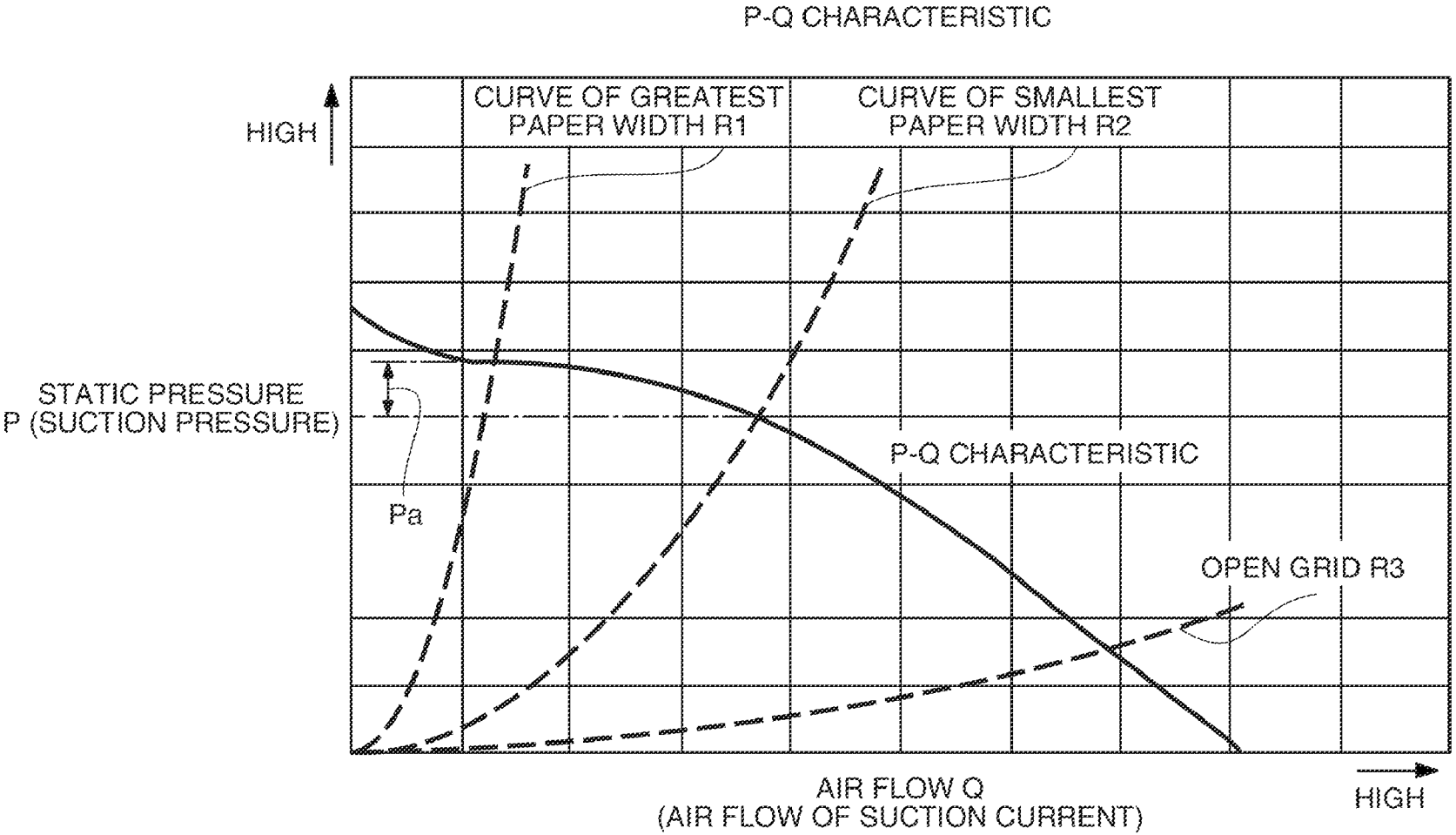
FIG. 7 is a graph of the P-Q characteristic showing the relationship between vacuum air flow and vacuum pressure.

FIG. 7 is a graph of the P-Q curve showing the relationship between the vacuum air flow (air flow Q) from the suction holes into the printing unit, and the vacuum pressure (static pressure P) from the suction holes. As shown in this graph, if the vacuum air flow increases due to air leakage from the suction holes, the vacuum pressure decreases. In order to appropriately hold the recording paper to the platen surface, the air flow including air leakage must be set and the vacuum platen must be designed to achieve a desirable vacuum pressure (so that the vacuum pressure is within the suitable pressure range Pa shown in FIG. 7, for example).

Curve R1 representing the P-Q characteristic in FIG. 7 shows the relationship between the vacuum air flow and the vacuum pressure when recording paper 12*a* with the largest expected paper width is pulled to the platen surface 25*a*. Curve R2 shows the relationship between air flow and vacuum pressure when recording paper 12*a* with the smallest expected paper width is pulled. Curve R3 shows the relationship between air flow and vacuum pressure when suction is applied without recording paper 12*a* being set on the transportation path A, that is, when the entire first suction hole 45 of the grid-shaped first suction area 51 is open and unobstructed.

In this embodiment of the invention the configuration of the platen surface 25*a* is set so that the vacuum pressure when recording paper 12*a* with the greatest width is pulled to the platen surface 25*a* is at the upper limit of the suitable pressure range Pa. In addition, the vacuum pressure when recording paper 12*a* with the narrowest width is conveyed does not drop much below that when the widest paper is conveyed and stops at the lower limit of the suitable pressure range Pa because all of at least the first suction hole 45 in the first suction area 51 is covered by the paper and the flow of leaking air is held to a minimal level. If all of the grid-shaped first suction hole 45 is open, the vacuum pressure drops significantly as indicated by curve R3, and it may not be possible to sustain the necessary vacuum pressure. However, because even the narrowest recording paper 12*a* covers all of the first suction area 51 in this embodiment of the invention, such a drop in vacuum pressure does not occur when paper is conveyed. Therefore, various widths of recording paper 12*a* ranging from the maximum expected width to the minimum width can be pulled to the platen with pressure within the suitable pressure range without adjusting the vacuum pressure produced by the vacuum fan 26*a*, and the paper can be conveyed flat.

Because fine grid-like chambers 44 are formed by the longitudinal ribs 41 and 42 and lateral ribs 43 in the first suction area 51 of the platen 25, all parts of the recording paper 12*a* traveling over the first suction area 51 can be pulled with an even vacuum pressure, and air leakage from the first suction hole 45 near the edges of the recording paper 12*a* can be reduced.

Furthermore, because the edges of the recording paper 12*a* do not fall into the fine grid of chambers 44, the recording paper 12*a* can be prevented from catching on parts of the first suction area 51. The recording paper 12*a* can also be prevented from catching even if the lateral ribs 43, 48, 49 are lower than the longitudinal ribs 41, 46, 47.

With the platen 25 according to this embodiment of the invention recording, the edges along the sides of paper 12 with a wide paper width will protrude into the second suction areas, but the edges of the recording paper 12*a* can be pulled to the second suction areas 52 and 53 by means of the vacuum pressure from the second suction holes 54 and 55. In the second suction areas, not even one second suction hole 54 and 55 is formed in the chambers 52*g*, 52*h*, 53*g*, 53*h* closest to the first suction area 51. This is because the portion of the recording paper 12*a* traveling over the chambers 52*g*, 52*h*, 53*g*, 53*h* closest to the first suction area 51 where the vacuum pressure is high can be reliably pulled to the platen by the high vacuum pressure in the first suction area 51, and the edges of the recording paper 12*a* will therefore not lift up even if suction is not applied in this area.

In the second suction areas 52 and 53, the second suction holes 54 and 55 are disposed in the chambers 52*a* to 52*d* and chambers 53*a* to 53*d* in the rows that are farthest and second farthest from the first suction area 51. As a result, when the paper width of the recording paper 12*a* is large and the paper extends far from the first suction area 51, the edges of the recording paper 12*a* can be pulled down and the recording paper 12*a* can be effectively pulled to the platen using a small aperture ratio. In addition, in the rows that are third and fourth farthest from the first suction area 51, the second suction holes 54 are formed in the chambers 52*e*, 52*f* and chambers 53*e*, 53*f* at the front in the recording paper transportation direction B, and suction holes are not formed in the chambers at the back in the recording paper transportation direction B. As a result, the edges at the leading end of the recording paper 12*a* that can easily lift away from the platen can be reliably pulled down. The configuration of the second suction holes 54 and 55 in this embodiment of the invention can thus effectively and reliably hold the edges of the recording paper 12*a* flat using a small aperture ratio in the second suction areas 52 and 53.

Furthermore, because the front edge H1 of the first suction area 51 in the center of the width of the platen surface 25*a* is offset slightly to the upstream side in the recording paper transportation direction B from the front edge H2 of the left and right second suction areas 52 and 53 of the platen 25 according to this embodiment of the invention as shown in FIG. 6, the first suction area 51 can be completely covered by the leading end of the recording paper 12*a* when the leading end of the recording paper 12*a* is positioned to the indexing position at the front end of the platen 25 and printing starts. Ink droplets discharged in the center of the paper width can therefore be prevented from spreading to the downstream side in the transportation direction and being pulled into the first suction hole 45 around the leading end of the recording paper 12*a* as a result of leaking air current flowing around the edge at the leading end of the recording paper 12*a* toward the first suction hole 45 in the first suction area 51. A drop in print quality at the leading end of the recording paper 12*a* can therefore be prevented.

The platen 25 and the vacuum mechanism 26 according to this embodiment of the invention are not limited to printers, and can be applied in any type of fluid droplet discharge device that discharges ink droplets from an ink droplet discharge head onto a sheet medium that is conveyed over the platen surface 25*a*.

Although the present invention has been described in connection with the preferred embodiments thereof with reference to the accompanying drawings, various changes and modifications will be apparent to those skilled in the art in light of such disclosure. Any and all such changes and/or modifications is intended to be included within the scope of the present invention to the extent embraced by any of the claims of this application.

What is claimed is:

1. A vacuum platen mechanism, comprising:

a platen surface disposed opposite a fluid droplet discharge head; and a vacuum mechanism that creates suction to draw recording paper to the platen surface;

wherein the platen surface includes a first suction area positioned approximately in a center of the platen surface in a width direction that is perpendicular to a direction in which the recording paper is conveyed, the first suction area including a plurality of first ribs extending in the recording paper transportation direction and a plurality of second ribs extending in the width direction defining a plurality of first chambers arranged in a grid layout, the first suction area defining a plurality of rectangular-shaped first suction holes, each rendered in a respective one of the first chambers, and a second suction area on each side of the first suction area, the second suction area defining a plurality of second suction holes that are non-rectangular-shaped, arranged in a different layout than the first suction holes, or both.

2. The vacuum platen mechanism described in claim 1, wherein the width of the first suction area is less than or equal to a minimum width of a guide that constrains both sides of the recording paper.

3. The vacuum platen mechanism described in claim 1, wherein, relative to the transportation direction of the recording paper, a downstream end of the first suction area is offset a specific distance to the upstream side from a downstream end of the second suction area.

4. The vacuum platen mechanism described in claim 1, further comprising:

a plurality of third ribs extending generally in the recording paper transportation direction, but at a slight angle thereto, and a fourth rib extending in the width direction, thereby defining a plurality of second chambers in the second suction area, wherein at least the second chamber farthest from the first suction area defines one of a plurality of second suction holes and at least the second chamber closest to the first suction area has no suction hole formed therein.

5. The vacuum platen mechanism described in claim 4, wherein an open area or an aperture ratio of a second suction hole on the downstream side of the fourth rib in the recording paper transportation direction is greater than that of a second suction hole on the upstream side of the fourth rib in the recording paper transportation direction.

6. The vacuum platen mechanism described in claim 4, wherein the third ribs are spaced at substantially equal intervals.

7. The vacuum platen mechanism described in claim 4, wherein the fourth rib is formed lower than each of the plurality of third ribs.

8. The vacuum platen mechanism described in claim 1, wherein each of the plurality of second ribs is formed lower than each of the plurality of first ribs.

9. The vacuum platen mechanism described in claim 1, further comprising:

a vacuum channel that communicates with the platen surface top through the first or the second suction holes; and a vacuum fan that draws air with a set suction force through the vacuum channel.

10. A fluid droplet discharge device, comprising:

the vacuum platen mechanism described in claim 1; and a fluid droplet discharge head that discharges fluid droplets onto the recording paper conveyed along the platen surface of the vacuum platen mechanism.

* * * * *